US006681533B1

(12) United States Patent
Doyle

(10) Patent No.: US 6,681,533 B1
(45) Date of Patent: Jan. 27, 2004

(54) APPARATUS FOR PREVENTING FLOODWATER FROM ENTERING A BUILDING

(75) Inventor: Roy Doyle, Thames GRP, Unit 8, Abattoirs Road, Reading, RG1 7BL (GB)

(73) Assignees: Roy Doyle, Wokingham (GB); Alan Wall, Wokingham (GB); Shiraz Mirza Beg, Wokingham (GB)

( * ) Notice: Subject to any disclaimer, the term of this patent is extended or adjusted under 35 U.S.C. 154(b) by 0 days.

(21) Appl. No.: 09/889,651

(22) PCT Filed: Jan. 26, 2000

(86) PCT No.: PCT/GB00/00200

§ 371 (c)(1),
(2), (4) Date: Dec. 7, 2001

(87) PCT Pub. No.: WO00/45022

PCT Pub. Date: Aug. 3, 2000

(30) Foreign Application Priority Data

Jan. 26, 1999 (GB) ..... 9901562

(51) Int. Cl.[7] ..... E06B 7/14

(52) U.S. Cl. ..... 52/107; 52/37; 52/169.6; 52/203

(58) Field of Search ..... 52/200–203, 37, 52/107, 169.6; 49/40, 504

(56) References Cited

U.S. PATENT DOCUMENTS

| | | | | | |
|---|---|---|---|---|---|
| 300,654 | A | * | 6/1884 | Smith | |
| 2,162,628 | A | * | 6/1939 | Martin | |
| 2,334,482 | A | * | 11/1943 | Davis | |
| 3,085,489 | A | * | 4/1963 | Ivy | |
| 3,099,900 | A | * | 8/1963 | Beck | |
| 3,123,868 | A | * | 3/1964 | Gust | |
| 3,844,076 | A | * | 10/1974 | Schock | 52/107 |
| 4,023,306 | A | * | 5/1977 | Ruggieri, Jr. | 47/40 |
| 4,330,500 | A | * | 5/1982 | Mackes | 264/554 |
| 4,896,467 | A | * | 1/1990 | McGinnis | 52/107 |
| 5,085,002 | A | * | 2/1992 | Lee et al. | 47/41.12 |
| D376,655 | S | * | 12/1996 | Lindsey | D25/53 |
| 5,647,154 | A | * | 7/1997 | Groves | 40/584 |
| 5,918,430 | A | * | 7/1999 | Rowland | 52/202 |
| 6,298,631 | B1 | * | 10/2001 | Finley | 52/742.15 |

FOREIGN PATENT DOCUMENTS

| | | |
|---|---|---|
| DE | 19503292 | 8/1996 |
| DE | 19527684 | 1/1997 |
| DE | 29710143 | 2/1998 |
| EP | 0683300 | 11/1995 |

* cited by examiner

*Primary Examiner*—Carl D. Friedman
*Assistant Examiner*—Yvonne M. Horton
(74) *Attorney, Agent, or Firm*—Robert W. J. Usher

(57) ABSTRACT

Apparatus for preventing flood water entering a building through a wall opening has a first member for permanent attachment to the wall and second member detachably fixed to the first member. The first member has a frame having first fixing mechanism and two upright members for permanent fixing to the wall around the opening and a third member bowed away from the building and having a flat upper surface. The second member has a curved member with circumferential flanges and a second fixing mechanism engaging the first fixing mechanism. Two flanges extend outwardly from the curved member, and third flange is perpendicular to flanges and to the curved member. The flanges fit flat against the members of the frame through a gasket with the third flange extending horizontally on top of the third member forming a step.

6 Claims, 5 Drawing Sheets

FIG. 4
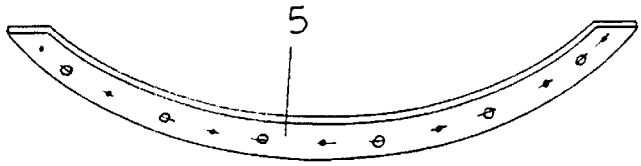
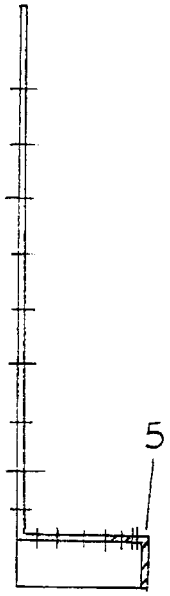
SECTION A-A
FIG 3
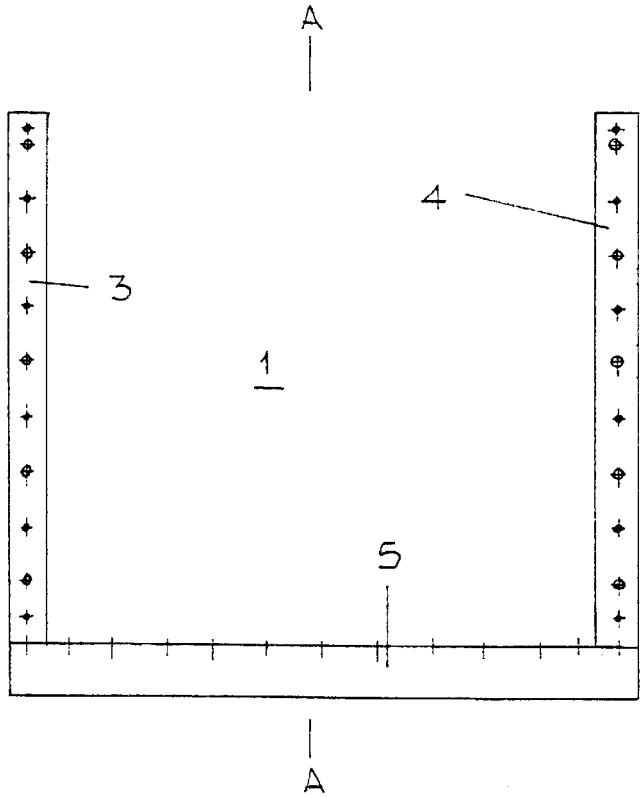
FIG 2

APPARATUS FOR PREVENTING FLOODWATER FROM ENTERING A BUILDING

This invention relates to apparatus for preventing flood water from entering a building. More particularly, this relates to apparatus for preventing flood water from entering a building which, when there is no danger of flooding, permits unimpeded entry into the building, but which when flooding is imminent, can be deployed to prevent the water from entering the building through doors, windows, airbricks, etc.

In buildings that are in low lying districts and in buildings which are close to beaches, etc. there is a danger that at times of flooding or high tide, the water can rise so high as to enter the buildings. These may be protected on an ad hoc basis, for instance, by placing sandbags around the doorways but this is unsatisfactory. Another form which is sometimes employed is in the form of duck boards, which can be slotted into frames surrounding the door, rather in the manner of a sash window. These, however, are not leak proof, and are ill-adapted to preventing water from entering a building by all the means by which it may do so. For instance, cellars or semi-basements often have an opening close to ground level which it is difficult to protect completely. In addition, such constructions as airbricks are again difficult to protect.

A clear need therefore exists for a means of preventing water from entering buildings.

According to the present invention, this is provided by apparatus for preventing flood water from entering a building which comprises a first member for permanent attachment to the walls of the building and adapted to fit around an opening in the building, and a detachable second member adapted to be fixed to said first member, wherein said first member comprises a frame adapted to fit around at least three sides of said opening and provided with first fixing means, and said second member comprises a curved member provided at its circumference with a flange, and second fixing means adapted to engage said first fixing means, and a gasket bonded to said second member around its circumference.

Advantageously, the first and second members are formed from glass-reinforced plastics material.

The present invention will be more clearly understood by reference to the accompanying Drawings in which:

FIGS. 2, 3 and 4 are respectively front, side and top views of the first member;

Figure 1:
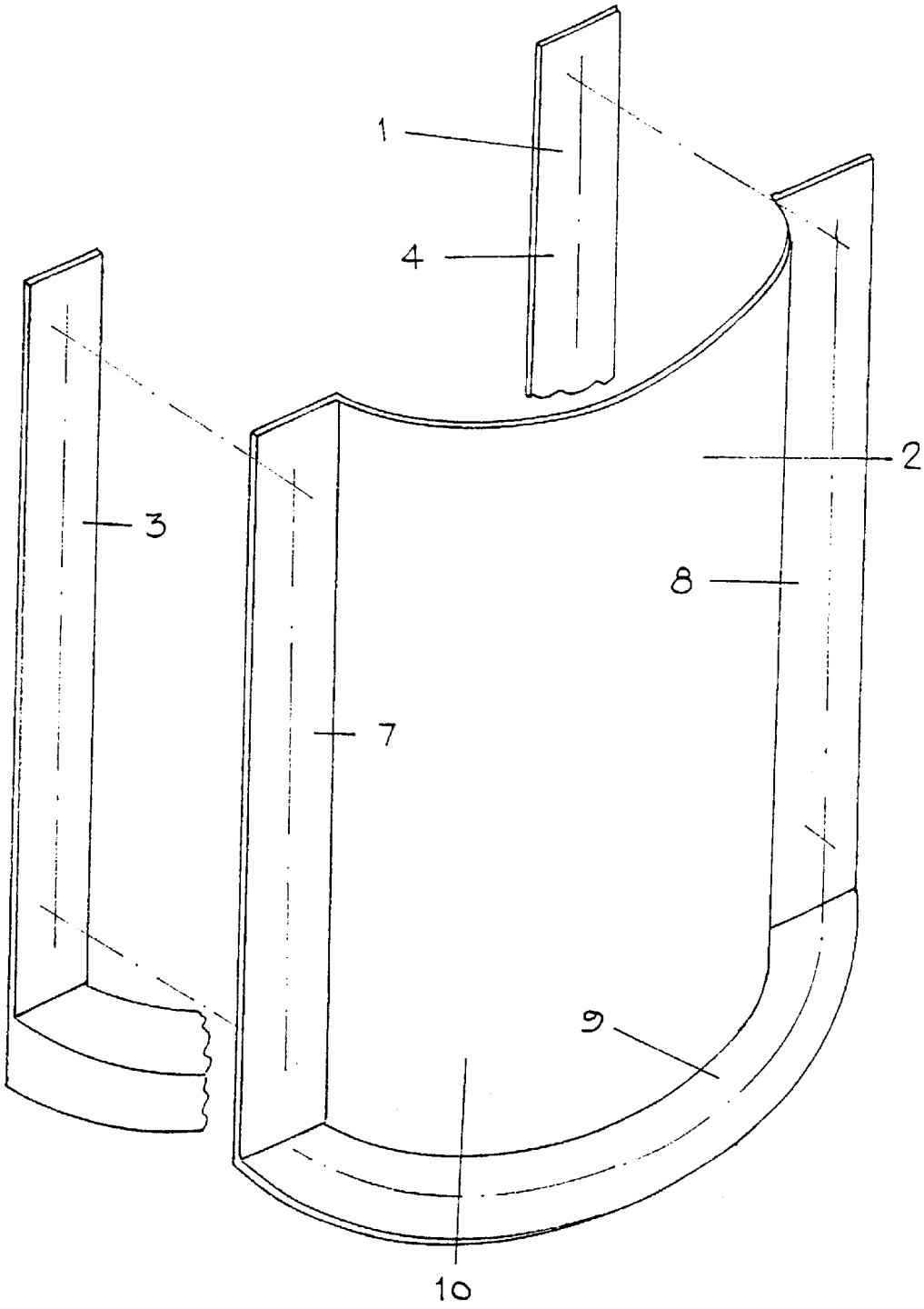
FIG. 1 is a partially disassembled view of the apparatus according to one preferred embodiment of the invention.
Figure 7:
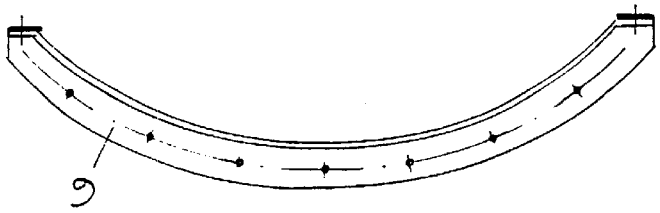
FIGS. 5, 6 and 7 are respectively front, side and top views of the second member.
Figure 6:
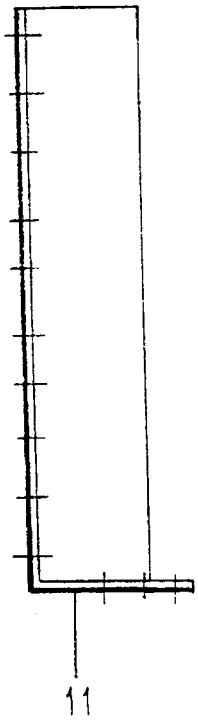
Figure 5:
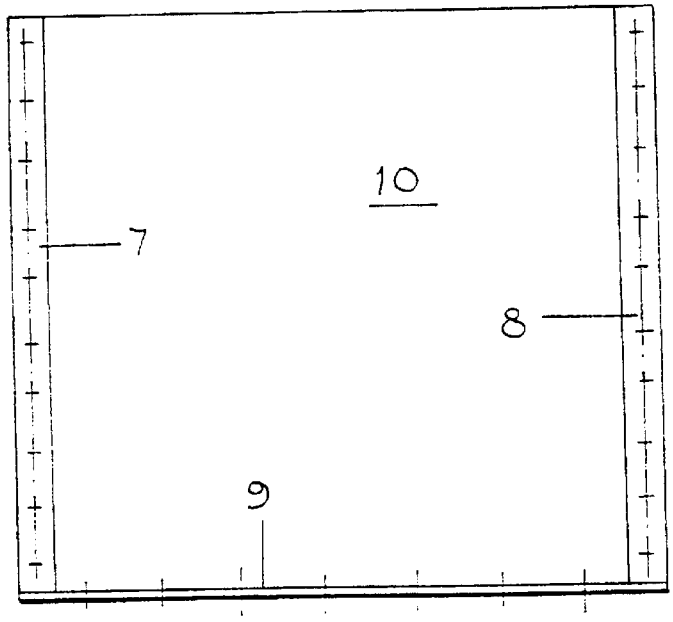
Figure 8A:
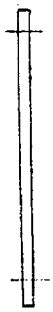
Figure 8:
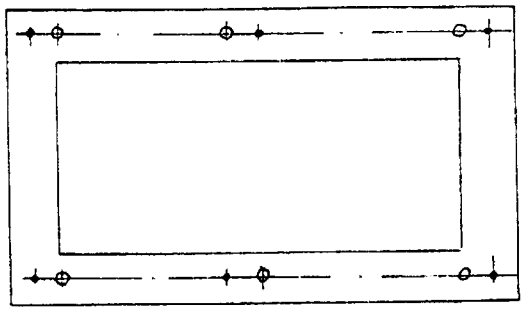
Figure 9:
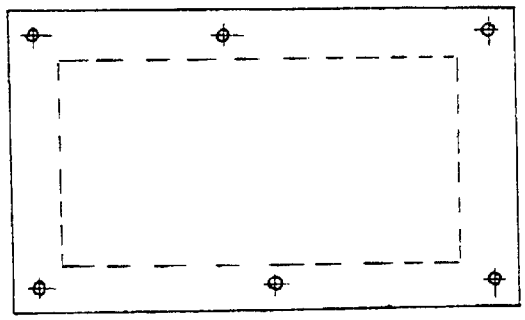
Figure 9A:
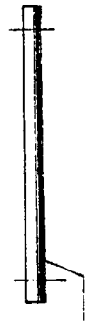
Figure 10:
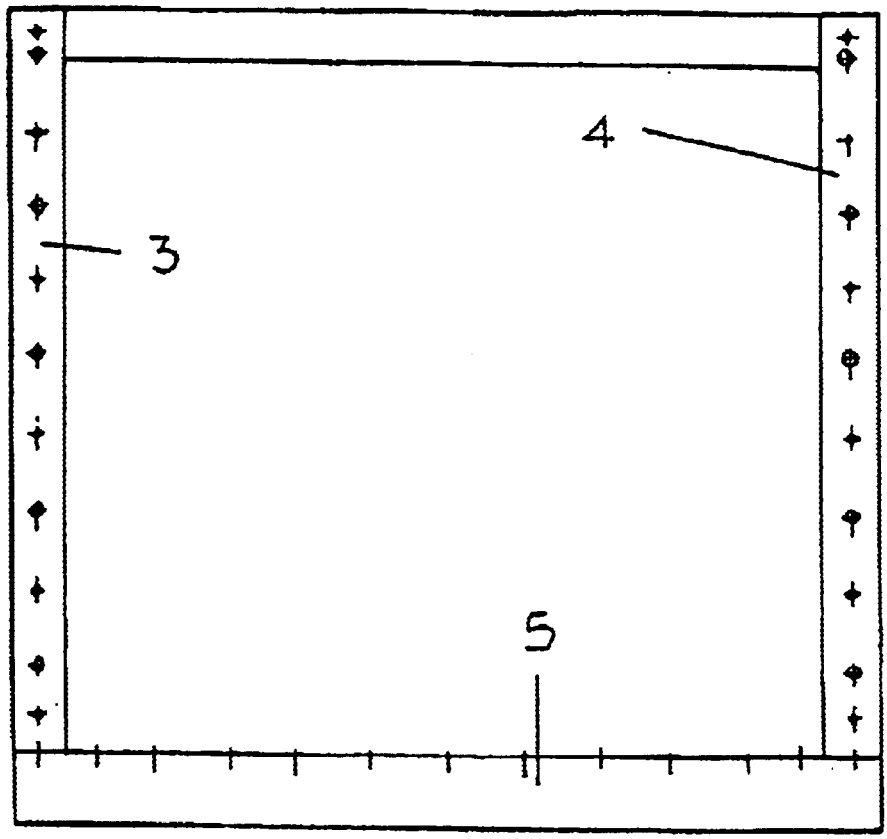

FIGS. 8 and 8*a* are respectively front and side views of an alternative embodiment of the first member;

FIGS. 9 and 9*a* are respectively front and side views of an alternative embodiment of the second member.: and FIG. 10 is a front view of a rectangular frame of an alternative embodiment.

Referring now to the Drawings, a system for protecting a door comprises a first member [1] and a second member [2]. The first member [1] is a frame which surrounds the bottom and sides of a door. Seen in elevation, it is U-shaped with two upright limbs [3] and [4] which are positioned on either side of the door and fixed to the wall with a permanent means, e.g. concreting, grouting or any other means which will be permanent and not susceptible to passage of water behind. The third member [5] is substantially horizontal and is bowed out from the front so as to form a curved member having a flat top and a downwardly directed portion which may be permanently fixed to the threshold of the building, i.e. by grouting or concreting into the step. This will have a flat upper surface and a downwardly directly front surface so as to be L-shaped in cross-section, although it can form a solid member if desired.

In this embodiment, the second member comprises a curved panel [10] surrounded by flanges [7, 8, 9]. Two of these flanges are directed upwards and the third is mutually at right angles to the first two and to the curved panel so as to form a horizontal step. The respective flanges are substantially shaped and sized so as to fit against the upright frame.

The first and second members are fastened together by means preferably of nuts and bolts. In a preferred method, a series of nuts are permanently embedded in the flange in the frame [3, 4, 5], and a corresponding number of holes are provided in the flanges [7, 8, 9] of the second member. When the second member is located in position, the two members are placed together and appropriate bolts are placed through the holes of the member and tightened and screwed into the nuts. A gasket [11] is permanently bonded to the face of the flanges which will be in contact with the frame when the object is in use.

Alternatively and less conveniently, the first member may have projecting bolts which fit through the holes in the second member when the two members fit together, their appropriate nuts and washers are tightened to form a waterproof seal. The frame and the panel are conveniently formed of glass reinforced plastic.

The panel has a curved profile so as to provide better resistance to water pressure in an alternative embodiment, as shown in FIGS. 8, 8*a*, 9 and 9*a*, for instance for use with an airbrick, the frame completely surrounds the airbrick, and the second member can be bolted over it. The second part in FIGS. 9 and 9*a* is shown as a flat member, but can be a curved panel if desired.

In either embodiment, the frame and panel may be made in a variety of sizes so as to accommodate buildings with various sizes of door.

In another embodiment, the first embodiment is modified in that the frame is rectangular, as shown in FIG. 10.

What is claimed is:

1. Apparatus for preventing flood water from entering a building, which comprises a first member (1) for permanent attachment to the walls of the building and adapted to fit around an opening in the building, and a detachable second member (2) adapted to be fixed to said first member, wherein said first member comprises a frame (3, 4, 5) adapted to fit around at least three sides of said opening and provided with first fixing means, said frame comprising two upright members (3,4) adapted for permanent fixing to the walls of the building on either side of the opening, and a third member (5) adapted for outward bowing away from the building and having a flat upper surface, and said second member comprise a curved member (10) provided at a circumference thereof with flanges (7,8,9) and with second fixing means adapted to engage said first fixing means, two of said flanges (7,8) being outwardly directed with respect to the curved member (10), and a third of said flanges (9) being mutually at right angles to flanges (7,8) and to said curved member, said flanges being shaped and sized to fit flat against the members (3,4,5) of said frame through a gasket [11] bonded to said second member around its circumference with said third of said flanges (9) extending horizontally on top of the third member (5) forming a step.

2. Apparatus as claimed in claim 1 wherein said first fixing means comprises threaded studs projecting from said frame and said second fixing means comprise nuts adapted to engage said threaded studs, said second member having bores through which said studs pass when the first and second members are in engagement.

3. Apparatus as claimed in claim 1 wherein said first fixing means comprises threaded nuts embedded in said frame and said second fixing means comprise bolts adapted to engage said nuts when passing through bores in said second member.

4. Apparatus as claimed in claim 1 wherein said first member has a rectangular frame adapted to surround completely an opening in the building.

5. Apparatus as claimed in claim 2 wherein said first member has a rectangular frame adapted to surround completely an opening in the building.

6. Apparatus as claimed in claim 3 wherein said first member has a rectangular frame adapted to surround completely an opening in the building.

* * * * *